US006457998B1

(12) United States Patent
Zhang et al.

(10) Patent No.: US 6,457,998 B1
(45) Date of Patent: Oct. 1, 2002

(54) ELECTRICAL CONNECTOR WITH IMPROVED CONTACTS

(75) Inventors: Jian-Qiang Zhang; Li-Qi Liu, both of Kunsan (CN)

(73) Assignee: Hon Hasi Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/952,993

(22) Filed: Sep. 14, 2001

(51) Int. Cl.[7] ..... H01R 24/06
(52) U.S. Cl. ..... 439/660; 439/79
(58) Field of Search ..... 439/79, 660

(56) References Cited

U.S. PATENT DOCUMENTS 5,904,597 A * 5/1999 Doi et al. ..... 439/660
6,048,228 A * 4/2000 Aso ..... 439/660
6,200,167 B1 * 3/2001 Aso ..... 439/660
6,241,558 B1 * 6/2001 Mosquera ..... 439/660
6,244,883 B1 * 6/2001 Ito et al. ..... 439/660
6,247,948 B1 * 6/2001 Davis et al. ..... 439/660

* cited by examiner

*Primary Examiner*—Gary R Paumen
(74) *Attorney, Agent, or Firm*—Wei Te Chung

(57) ABSTRACT

An electrical connector includes an insulative housing (1), a first set of contacts (3) connecting to a first powering device and a second set of contacts (5) connecting to a second powering device. The first set of contacts has a first contact (31) and a second contact (32). The second set of contacts has a third contact (51), a fourth contact (53), a fifth contact (54) and a connecting element (52). The third and the fifth contacts respectively have a first and a second bias terminals (516, 543). A first electrical circuit is formed by the second and the third contacts and the connecting element. A second electrical circuit is formed by the first, the fourth and the fifth contacts. The first and the second electrical circuits are respectively connected to circuit traces of a PCB through the first and the second bias terminals.

1 Claim, 5 Drawing Sheets

ELECTRICAL CONNECTOR WITH IMPROVED CONTACTS

FIELD OF THE INVENTION

The present invention generally relates to an electrical connector, and more particularly to an electrical connector with improved first and second sets of contacts to connect an electronic device to a first and a second powering devices.

BACKGROUND OF THE INVENTION

It is well known that mobile phones use electrical connectors to charge. The connectors are usually provided with two sets of contacts adapted for respectively connecting to two types of powering devices.

CN Patent No. 99256239.2 discloses a conventional electrical connector. As shown in FIG. 5, the electrical connector is provided with a housing 2 and a first and a second sets of contacts 4, 6 respectively connecting a mobile phone with a first and a second powering devices. The first set of contacts 4 includes a first and a second contacts 41, 43. The first and the second contacts 41, 43 respectively have a first and a second connecting portions 413, 433. The second set of contacts 6 includes a third contact 61, a fourth contact 63 having a connecting section 637, and a connecting element 65. The third contact 61 includes a rigid pin 611 for connecting with a terminal of the second powering device and a first flexible arm 613 extending out of the electrical connector for electrically connecting to a printed circuit board (PCB) of the mobile phone. The fourth contact 63 has a second flexible arm 632 also extending out of the electrical connector and electrically connecting to the PCB of the mobile phone. The second and the fourth contacts 43, 63 are connected by the second connecting portion 433 of the second contact 43 abutting the connecting section 637, thereby forming a first electrical circuit therein. The first and the third contacts 41, 61 are connected by the third and the fourth connecting portions 651, 653 of the connecting element 65 respectively abutting a lower portion of the third contact 61 and the first connecting portion 413 of the first contact 41, thereby forming a second electrical circuit therein. The first and the second electrical circuits connect with circuit traces of the PCB of the mobile phone through the first and the second flexible arms 613, 632.

However, the third contact 61 described above integrates the rigid contact 611 and the first flexible arm 613, which needs a complicated process in manufacturing and leads to a waste of material. Moreover, the first and the second contacts 41, 43 are respectively connected to the third and the fourth contacts 61, 63 by the first and the second connecting portions 413, 433 respectively abutting the fourth connecting portion 653 and the connecting section 637, which may not be a reliable connection.

Hence, an improved electrical connector is needed to overcome the forgoing shortcomings.

BRIEF SUMMARY OF THE INVENTION

A main object of the present invention is to provide an electrical connector adapted for connecting an electronic device with two powering devices.

Another object of the present invention is to provide an electrical connector which is easy for manufacturing.

An electrical connector for connecting an electronic device with a first and a second powering devices according to the present invention comprises an insulative housing and a first and a second sets of contacts received in the housing.

The housing includes a first and a second slots and a mating hole. The first set of contacts are connected to the first powering device and include a first and a second contacts. The second set of contacts are connected to the second powering device and comprise a third, a fourth, a fifth contacts and a connecting element. The third and the fifth contacts respectively have a first and a second bias terminals extending beyond the housing through the first and the second slots for terminating to the electronic device. The fourth contact partially extends into the mating hole of the housing. The connecting element connects the third and the second contacts. The fourth and the fifth contacts are separately formed and electrically connect with each other by the first contact.

Other objects, advantages and novel feather of the invention will become more apparent from the following detailed description when taken in conjunction with the accompanying drawings.

DETAILED DESCRIPTION OF THE INVENTION

Figure 1:
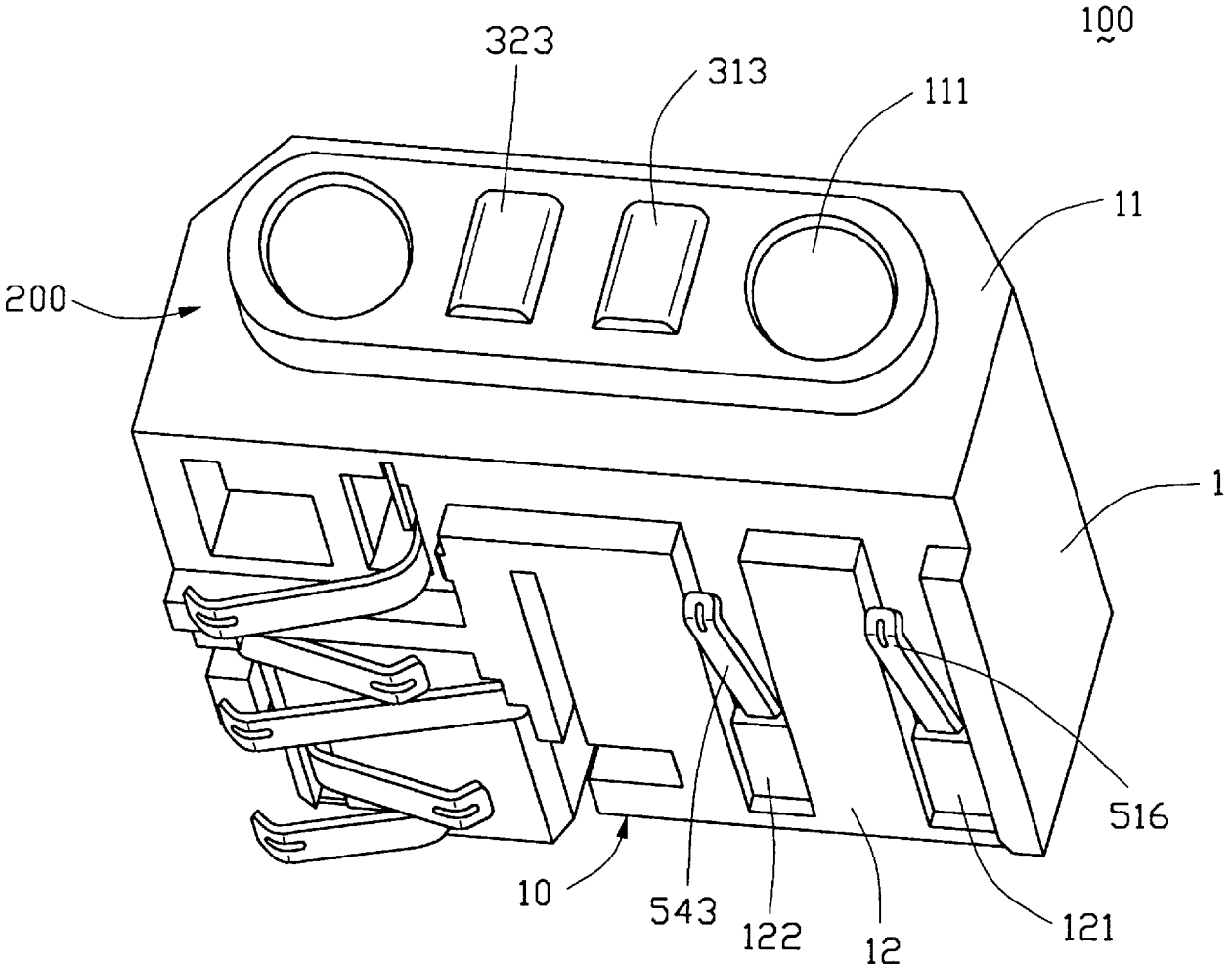
FIG. 1 is a perspective view of an electrical connector according to the present invention.

Referring to FIG. 1, an electrical connector 100 according to the present invention includes an insulative housing 1, a first set of contacts 3 adapted for connecting to a first powering device (not shown) and a second set of contacts 5 adapted for connecting to a second powering device (not shown). The electrical connector 100 can further integrate with a conventional audio jack 200. Since the structure of the audio jack 200 is well known to those skilled in the art, a detailed description thereof is omitted herein.

Figure 4:
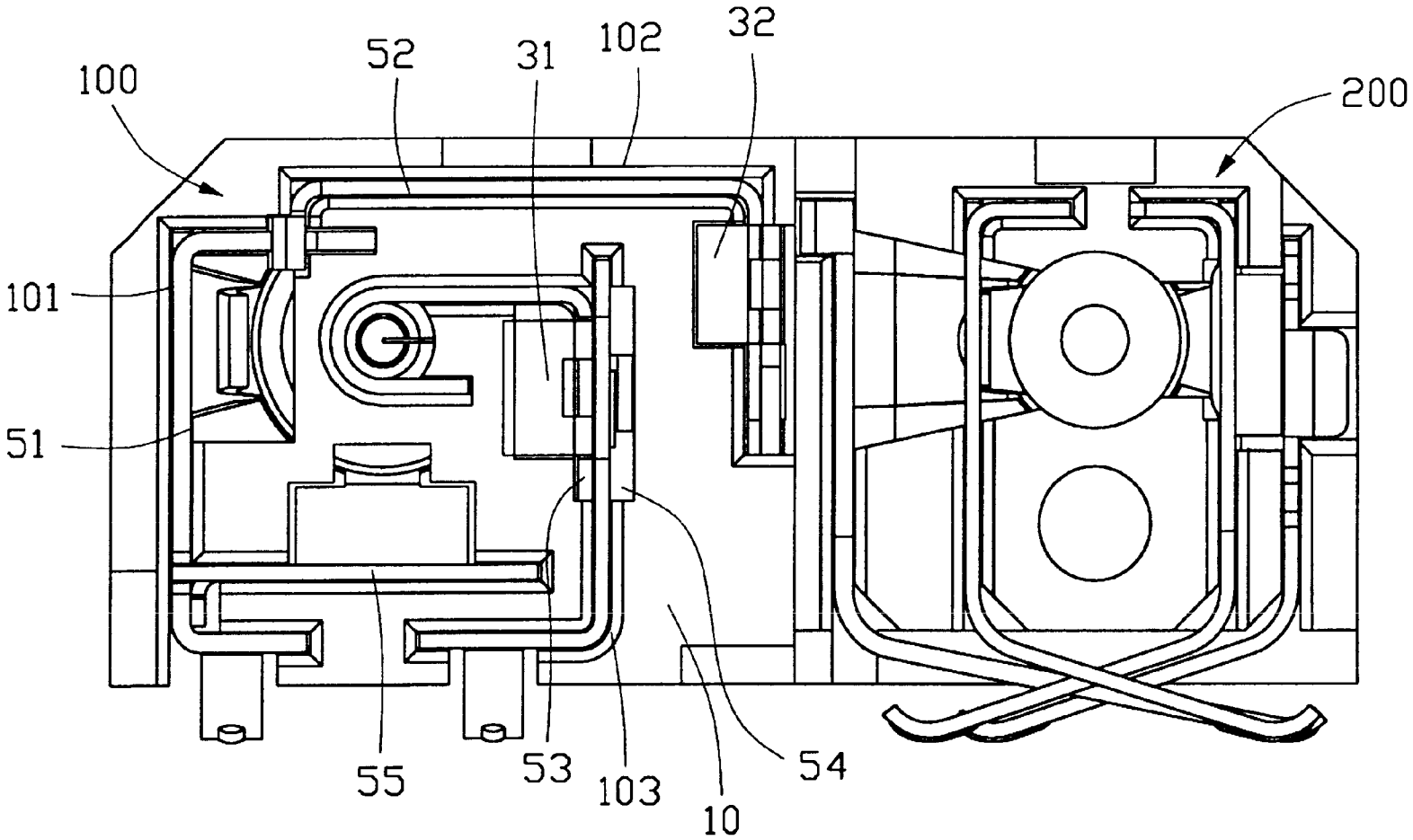
FIG. 4 is a back view of FIG. 1.
Figure 5:
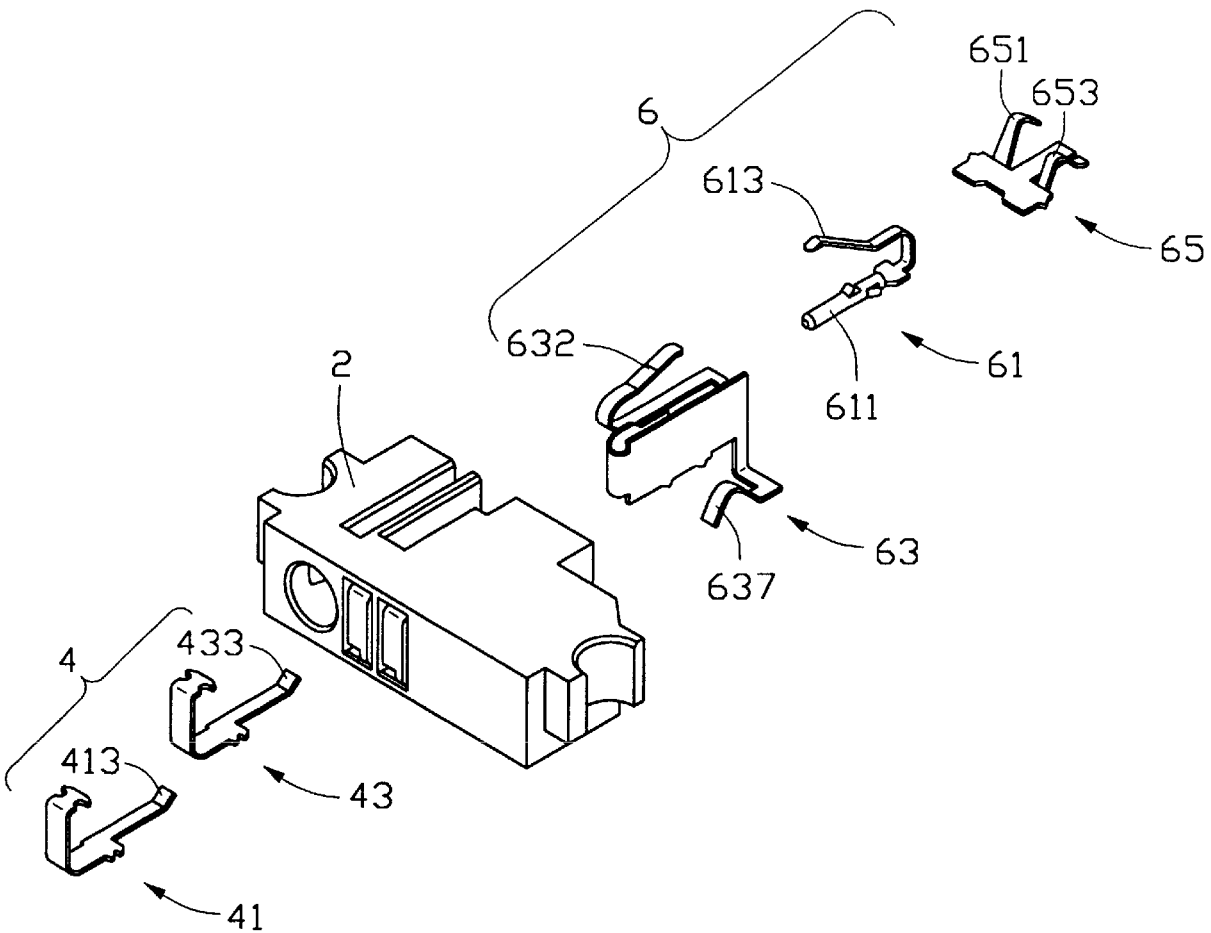
FIG. 5 (PRIOR ART)
FIG. 5 is an exploded view of a conventional electrical connector.

Referring to FIGS. 1 and 4, the housing 1 includes a back wall 10, a mating wall 11, and a mounting wall 12 between the back wall 10 and the mating wall 11. The back wall 10 has a first, a second and a third cavities 101, 102 and 103. The first cavity 101 communicates with the second cavity 102. The mounting wall 12 defines a first and a second slots 121, 122. The first and the second slots 121, 122 are parallel to each other and respectively communicate with the first and the third cavities 101, 103. The housing 1 has a mating hole 111 for receiving a terminal pin 7 of the second powering device and a pair of mounting channels (not shown) for mounting the first set of contacts 3. The mating hole 111 and the mounting channels are exposed to the mating wall 11. Each of the first, the second and the third cavities 101, 102 and 103 communicates with the mating hole 111.

Figure 2:
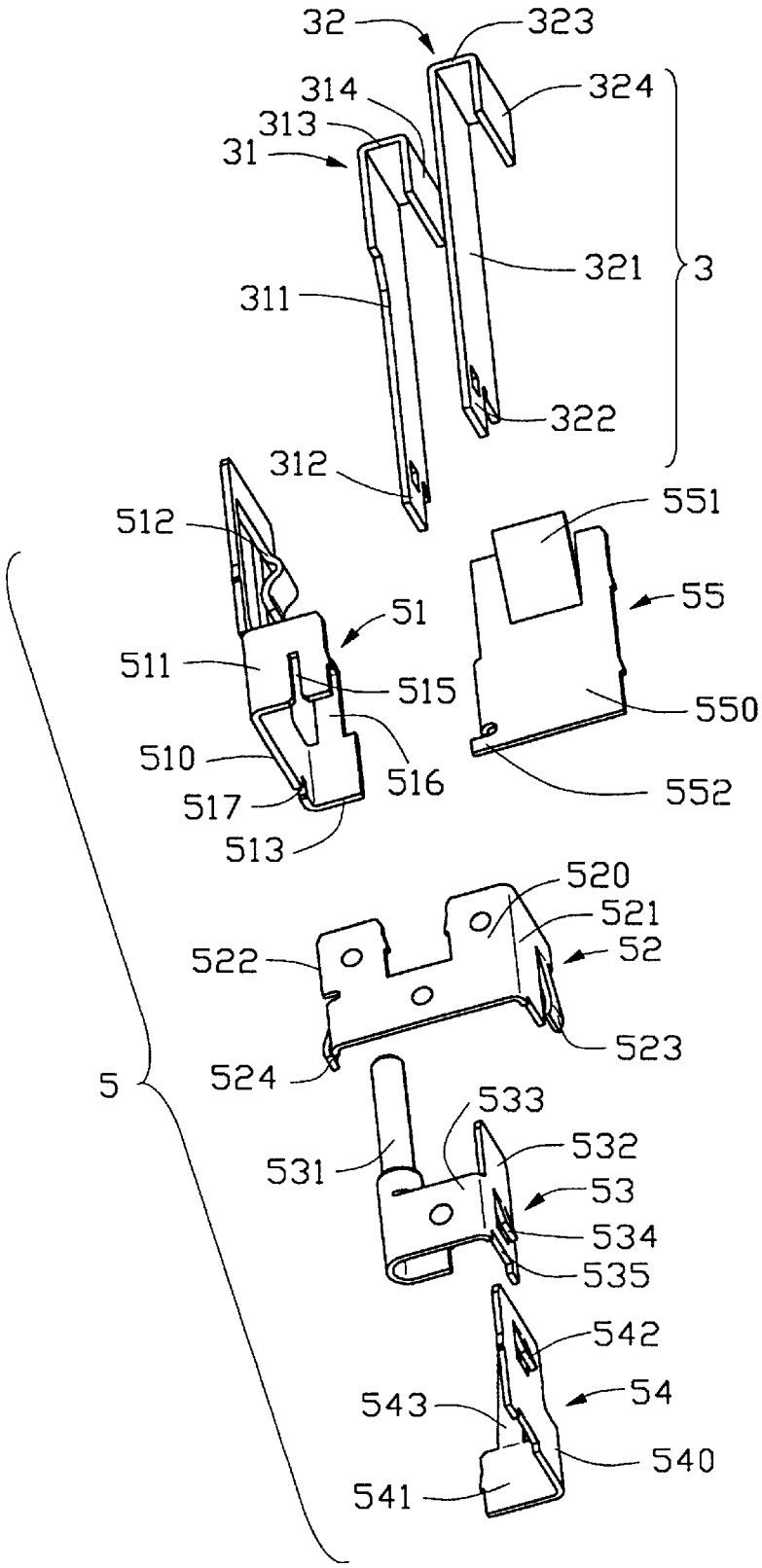
FIG. 2 is an exploded view of a first and a second sets of contacts of the electrical connector of FIG. 1, wherein a first tab of a first contact and a second tab of a second contact is not bent.

Referring to FIG. 2, the first set of contacts 3 includes a first contact 31 and a second contact 32. The first and the second contacts 31, 32 respectively have a first and a second longitudinal body portions 311, 321. A first and a second mating portions 313, 323 respectively extend perpendicularly from front ends of the first and the second longitudinal body portions 311, 321 and a first and a second tabs 312, 322 extend respectively from rear ends of the longitudinal body portions 311, 321. A first and a second detent portions 314, 324 respectively extend perpendicularly from a free end of the first and the second mating portions 313, 323.

The second set of contacts 5 includes a third contact 51, a fourth contact 53, a fifth contact 54, a sixth contact 55, and a connecting element 52. The third contact 51 includes a vertical body portion 510 and an upper and a lower plate 511, 513 respectively extending from an upper and a lower edge of the vertical body portion 510. The vertical body portion 510 forms a first contact tab 512 projecting inwardly and defines a first notch 517 in a rear edge thereof. The upper plate 511 defines a second notch 515 in a rear edge thereof. A first bias terminal 516 extends forwardly and downwardly from a front edge of the lower plate 513.

The connecting element 52 includes a traverse body portion 520, and a first and a second side plates 521, 522 respectively depending downwardly from opposite sides of the body portion 520. The first and the second side plates 521, 522 respectively form a first and a second hooks 523, 524.

The fourth contact 53 includes a rigid pin 531, a vertical first blade 532 opposite to the rigid pin 531, and a connecting portion 533 connecting the rigid pin 531 and the first blade 532. The first blade 532 defines an indentation 535 in a rear edge thereof. A first barb 534 projects outwardly from the first blade 532.

The fifth contact 54 includes a vertical second blade 540 and a lower board 541 extending from a lower end of the second blade 540. A second barb 542 projects outwardly from the second blade 540. A second bias terminal 543 extends forwardly and downwardly from a front edge of the lower board 541.

The sixth contact 55 has a base 550. A second contact tab 551 projects upwardly from a front portion of the base 550. A locking tab 552 extends from a rear end of the base 550.

Figure 3:
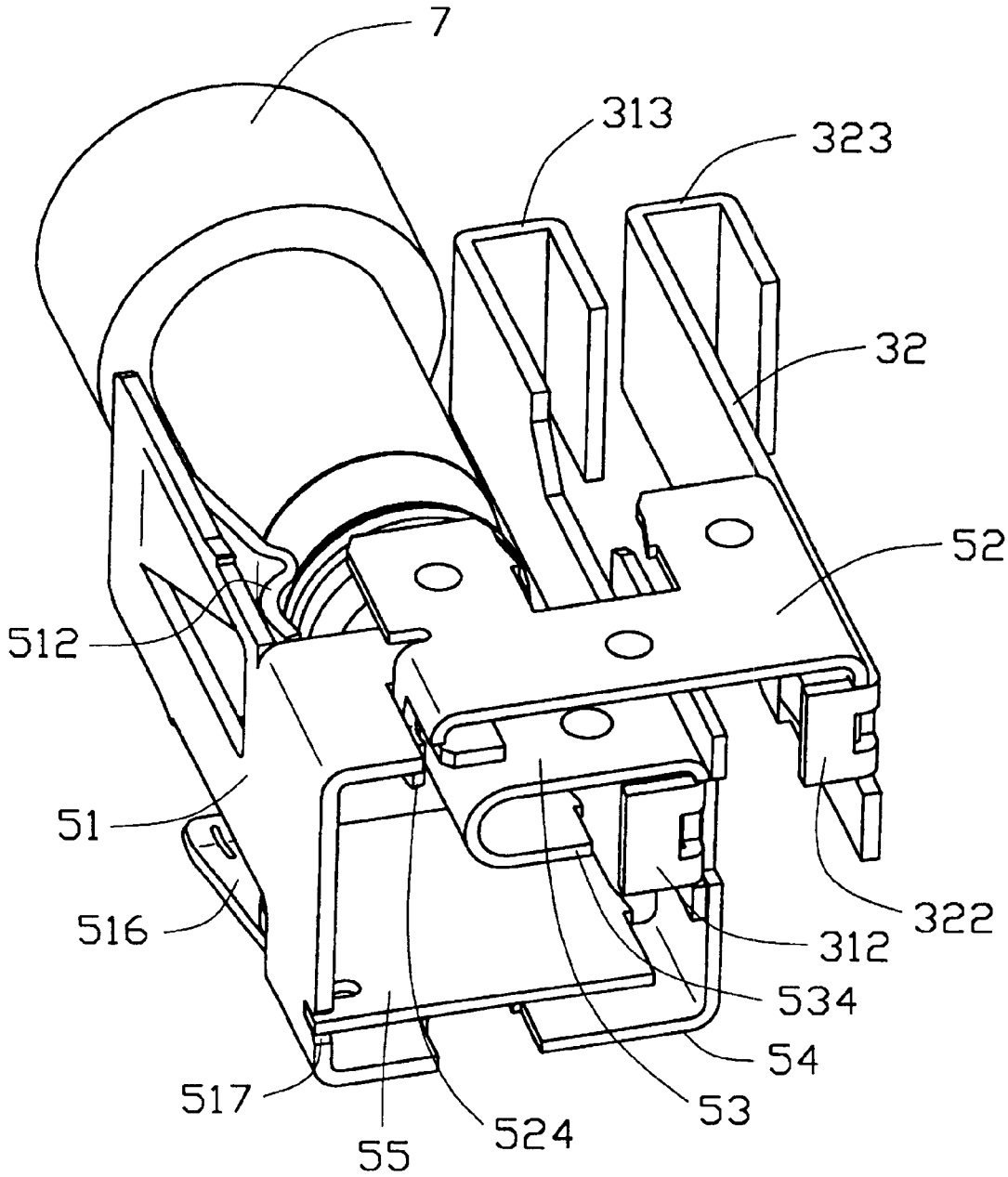
FIG. 3 is an assembled view of FIG. 2 with a terminal pin of a second powering device inserted therein.

Referring to FIGS. 1, 3 and 4, during assembly, the first and the second sets of contacts 3, 5 are mounted in the housing 4. The first and the second contacts 31, 32 of the first set of contacts 3 are inserted into the housing 1 through the mounting channels from the mating face 11. The first and the second mounting detent portions 314, 324 respectively engage with locating slits (not shown) in the housing 1 adjacent to the mounting channels. The first and the second mating portions 313, 323 are exposed to the mounting channels for electrically engaging with the first powering device. The first and the second tab 312, 322 respectively extend into the second and the third cavities 102, 103.

The second set of contacts 5 is inserted into the housing 1 from the back wall 10. The third and the sixth contacts 51, 55 are received in the first cavity 101. The locking tab 552 of the sixth contact 55 engages with the first notch 517 of the third contact 51. The first contact tab 512 of the third contact 51 and the second contact tab 551 of the sixth contact 55 respectively extend into the mating hole 111 of the housing 1 for mating with an outer periphery of the terminal pin 7 of the second powering device.

The connecting element 52 is received in the second cavity 102. The second hook 524 engages with the second notch 515 of the third contact 51 in a communication area (not labeled) of the first and the second cavities 101, 102. The first hook 523 of the sixth contact 55 abuts against a side of the second longitudinal body 321 of the second contact 32. The second tab 322 of the second contact 32 is bent substantially perpendicularly to the second longitudinal body portion 321 to engage with an upper portion (not labeled) of the first side plate 321.

The fourth and the fifth contacts 53, 54 are received in the third cavity 103. The rigid pin 531 is received in the mating hole 111 for engaging with an inner periphery of the terminal pin 7. The rigid pin 531 is aligned with a longitudinal center-line (not shown) of the mating hole 111 without connecting with the first or the second contact tabs 512, 551. The first tab 312 of the first contact 31 is bent perpendicularly to the first longitudinal body portion 311 and engages with the indentation 535 of the fourth contact 53. The first barb 534 of the fourth contact 53 abuts against a side of the first longitudinal body portion 311 of the first contact 31. An opposed side of the first longitudinal body portion 311 abuts against the second blade 540 of the fifth contact 54. The second barb 542 of the fifth contact 54 abuts against an inner wall (not labeled) of the housing 1. The first bias terminal 516 of the third contact 51 and the second bias terminal 543 of the fifth contact 54 respectively extend out of the housing 1 for engaging with circuit traces on a printed circuit board (PCB) (not shown) of the electronic device through the first and the second slots 121, 122.

The first and the second sets of contacts 3, 5 are connected as follows.

The second hook 524 of the connecting element 52 is inserted into the second notch 515 of the third contact 51. The first hook 523 of the connecting element 52 abuts against the second longitudinal body portion 321 of the second contact 32, and the second tab 322 of the second contact 32 is bent to engage with the upper portion of the first side plate 521, thereby connecting the second and the third contacts 32, 51. The locking tab 552 of the sixth contact 55 engages with the first notch 517 of the third contact 51. A first electrical circuit is formed between the second, the third and the sixth contacts 32, 51 and 55 and the connecting element 52.

The first tab 312 of the first contact 31 is bent to engages with the indentation 535 of the fourth contact 53, the first barb 534 of the fourth contact 53 abuts against one side of the longitudinal body portion 311 of the first contact 31, the opposed side of the longitudinal body portion 311 abuts the second blade 540 of the fifth contact 54, and the second barb 542 of the fifth contact 54 abuts against the inner wall of the housing 1, thereby connecting the first, the fourth and the fifth contact 31, 53 and 54 and forming a second electrical circuit between the first, the fourth and the fifth contact 31, 53 and 54.

The first and the second bias terminals 516, 543 respectively extend beyond the housing 1 through the first and the second slots 121, 122 for respectively connecting to circuit traces of the PCB of the electronic devices, the first and the second electrical circuits respectively connect to the electronic device through the first and the second bias terminals 516, 543.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting an electronic device with a first and a second powering device comprising:

an insulative housing including a first and a second slots and a mating hole;

a first set of contacts received in the housing for connecting the electronic device with the first powering device, the first set of contacts including a first and a second contact; and a second set of contacts received in the housing for connecting the electronic device with the second powering device, the second set of contacts including a third contact, a fourth contact, a fifth contact and a connecting element, the third and the fifth contacts respectively having a first and a second bias terminal extending beyond the housing through the first and the second slots for terminating to the electronic device, the fourth contact partially extending into the mating hole of the housing, the connecting element connecting the third and the second contacts, the fourth and the fifth contacts being separately formed and electrically connected with each other by the first contact;

wherein the fourth contact includes a rigid pin extending into and aligned with the mating hole of the housing;

wherein the fourth contact has an indentation in a rear end thereof, and wherein the first contact includes a longitudinal body portion and a tab extending rearwardly from an end of the longitudinal body portion, the tab being bent and engaged with the indentation of the fourth contact;

wherein the fourth contact further defines a barb abutting against one side of the longitudinal body portion of the first contact;

wherein the fifth contact includes a blade abutting against the other side of the longitudinal body portion of the first contact, the blade forming a second barb abutting against the housing;

wherein the third contact includes a contact tab extending into the mating hole without contacting the rigid pin of the fourth contact;

further comprising a sixth contact, the sixth contact including a contact tab extending into the mating hole without contacting the rigid pin of the fourth contact, and a locking tab extending laterally, and wherein the third contact defines a first notch for receiving the locking tab;

wherein the second contact includes a longitudinal body portion and a tab extending rearwardly from and end of the longitudinal body portion, and wherein the connecting element has a first hook abutting against the longitudinal body portion of the second contact, the tab of the second contact being bent and engaged with the connecting element;

wherein the third contact defines a second notch, and wherein the connecting element defines a second hook engaged with the second notch.

* * * * *